United States Patent [19]

Hiraishi et al.

[11] 3,936,305

[45] Feb. 3, 1976

[54] COLOR PHOTOGRAPHIC PHOTOSENSITIVE MATERIAL CONTAINING ULTRAVIOLET RAY-ABSORBING COMPOUND

[75] Inventors: Shigetoshi Hiraishi; Kiyoshi Futaki; Shoichi Horii; Kiyoshi Yamashita, all of Nagaokakyo, Japan

[73] Assignee: Mitsubishi Paper Mills, Ltd., Japan

[22] Filed: Dec. 2, 1974

[21] Appl. No.: 528,925

[30] Foreign Application Priority Data

Dec. 3, 1973 Japan ..... 48-134404

[52] U.S. Cl. ..... 96/84 UV; 252/300; 260/308 B; 427/160

[51] Int. Cl.[2] ..... G03C 1/84

[58] Field of Search ..... 96/84 UV; 427/160; 260/308 B; 252/300

[56] References Cited

UNITED STATES PATENTS

| | | | |
|---|---|---|---|
| 3,184,472 | 5/1965 | Carboni | 260/308 B |
| 3,684,729 | 8/1972 | Tuite | 96/84 UV |
| 3,700,455 | 10/1972 | Ishikawa et al. | 96/84 UV |
| 3,705,805 | 12/1972 | Nittel et al. | 96/84 UV |
| 3,754,919 | 8/1973 | Sobel et al. | 96/84 UV |

*Primary Examiner*—Ronald H. Smith
*Attorney, Agent, or Firm*—Cushman, Darby & Cushman

[57] ABSTRACT

Compounds represented by the following general formula are extremely effective as ultraviolet ray-absorbing agent, especially, for color photographic photosensitive materials.

(wherein $R_1$ is an alkyl group having 1 to 13, preferably 5 to 13 carbon atoms, $R_2$ is an alkyl group having 1 to 18 carbon atoms and X is hydrogen, a halogen, an alkyl, an alkoxy, an aryloxy, an aralkyloxy or an aryl group).

13 Claims, No Drawings

COLOR PHOTOGRAPHIC PHOTOSENSITIVE MATERIAL CONTAINING ULTRAVIOLET RAY-ABSORBING COMPOUND

The present invention relates to a novel ultraviolet ray-absorbing compound and color photographic photosensitive materials containing the same.

It is well known that ultraviolet ray gives adverse effect on photographic images. Especially, color images formed by color development of color photographic photosensitive material are made of dyes produced in photosensitive emulsion layer by reaction between a color former and an oxidation product of an aromatic primary amine developer and said color images are apt to cause discoloration and fading by irradiation with ultraviolet ray. Moreover, color former which remains in the photosensitive emulsion layer after formation of color image causes color change, coloration in a final color photograph due to action of ultraviolet ray.

Incorporation of an ultraviolet ray-absorbing agent into color photographic photosensitive materials has been generally conducted to intercept ultraviolet ray which has the adverse action as referred to above to eliminate the defects in photographs.

It is required for ultraviolet ray-absorbing agents used for color photography that they effectively absorb light of ultraviolet region of 300 – 400 mμ, they are colorless or nearly colorless, namely do not absorb visible light having a wavelength of more than 420 mμ, they are not decomposed or colored due to exposure to light and ultraviolet ray-absorbing ability of them does not decrease. Furthermore, the ultraviolet ray-absorbing agents used for color photography must not have adverse action on photographic photosensitive materials during their preparation or storage. Moreover, they must not be lost during development to prevent coloration of photographic layers. In addition, they should have good compatibility with a solvent used for adding them to photosensitive materials and at the same time they must be stable against ultraviolet ray.

A number of compounds have been known as ultraviolet ray-absorbing agent, but a few of them satisfy said requirements, among which hydroxybenzotriazole is known as an excellent ultraviolet ray-absorbing agent. This hydroxybenzotriazole type ultraviolet ray-absorbing agent exhibits excellent ultraviolet ray-absorbing effect when it is dispersed and incorporated in photosensitive materials by the so-called protect method, namely, a solution obtained by dissolving the ultraviolet ray-absorbing agent in an organic solvent of high boiling point or a mixed organic solvent comprising organic solvents of high boiling point and low boiling point is emulsified and dispersed in a hydrophilic protective colloid solution such as gelatin. In order to increase ultraviolet ray-absorbing effect, amount of the ultraviolet ray-absorbing agent used has been increased. However, if the agent has low compatibility with the organic solvent, naturally a larger amount of the organic solvent is used to result in adverse effects on photographic characteristics such as deterioration of emulsion layer, reduction in color formability, etc. On the other hand, when amount of ultraviolet ray-absorbing agent is increased without increasing amount of the organic solvent, the ultraviolet ray-absorbing agent is crystallized out in preparation of photosensitive material or storage thereof to cause great decrease in ultraviolet ray-absorbing effect and to give extremely adverse effect on photographic characteristics. Therefore, in order to eliminate the adverse effect on photographic characteristics in the case of employing said dispersing method, it is essential that the ultraviolet ray-absorbing agent has high solubility in the organic solvent. Ultraviolet ray-absorbing agent excellent in solubility does not damage the photographic characteristics and increases ultraviolet ray-absorbing effect. Therefore, it is not separated in crystal state or oily state from protective layer in the dispersion and can be used in a stable high concentration in an emulsion layer of 1 – 3 μm in thickness.

It has been found that compounds represented by the following formula [I] are markedly effective as ultraviolet ray-absorbing agent.

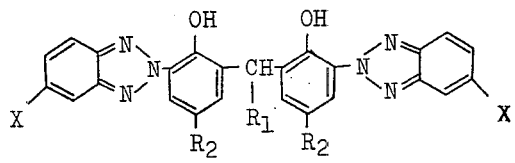

[I]

(wherein $R_1$ is an alkyl group having 1 to 13 carbon atoms, preferably 5 to 13 carbon atoms, $R_2$ is an alkyl group having 1 to 18 carbon atoms and X is hydrogen, a halogen, an alkyl group, an alkoxy group, an aryloxy group. aralkyloxy group or an aryl group).

The compounds represented by the general formula [I] can be incorporated into photosensitive material, for example, in the following manner. That is, the compound is dissolved in a water-immiscible organic solvent of high boiling point or a mixed liquid of organic solvents of high boiling point and low boiling point, the resultant solution is emulsified and dispersed in a hydrophilic protective colloid solution such as gelatin used in a photosensitive material and this is incorporated in suitable layers. Examples of said high boiling point organic solvents are phthalic acid ester, phosphoric acid ester, benzoic acid ester, sebacic acid ester, stearic acid ester, adipic acid ester, maleic acid ester, succinic acid ester, biphenyl derivatives, etc. Examples of said low boiling point organic solvents are ethyl acetate, ethyl propionate, sec-butyl alcohol, chloroform, ethanol, ethylene glycol, hexane, cyclohexane, dioxane, etc. These are merely examples and any solvents which can stably disperse the compounds of the present invention in protective colloid may be used.

Representative examples of the compounds represented by the general formula [I] are as follows:

Compound No. 1

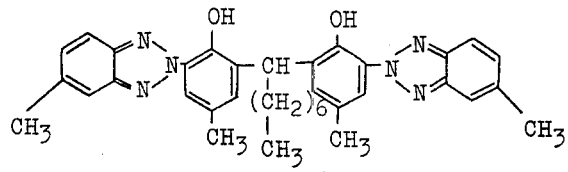

Compound No. 2
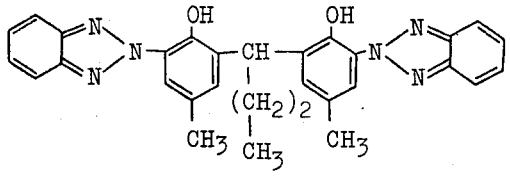
Compound No. 3
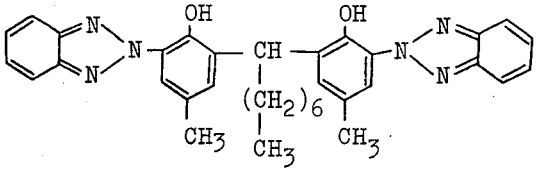
Compound No. 4
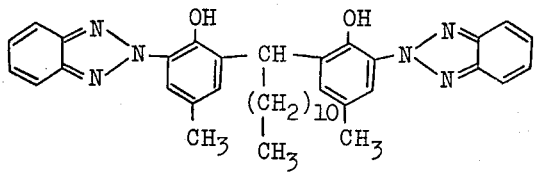
Compound No. 5
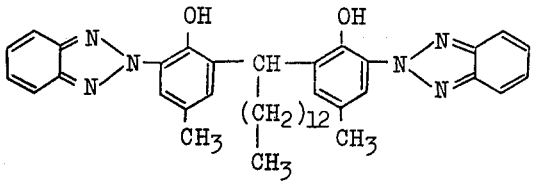
Compound No. 6
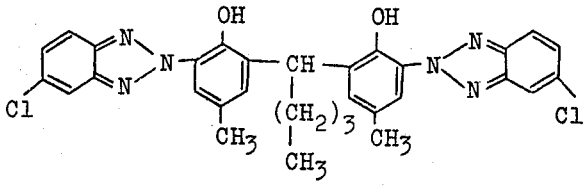
Compound No. 7
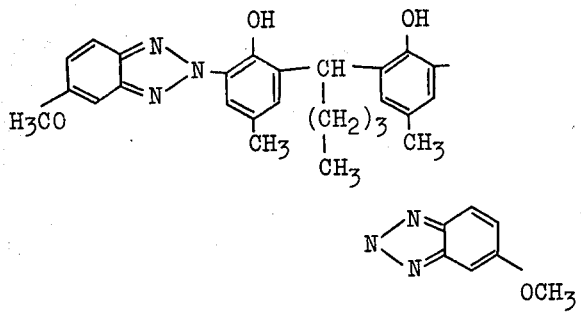
Compound No. 8
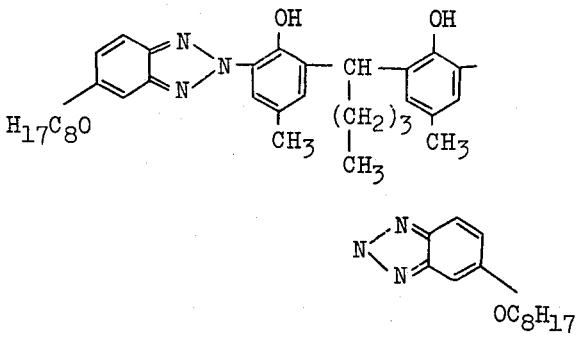
Compound No. 9
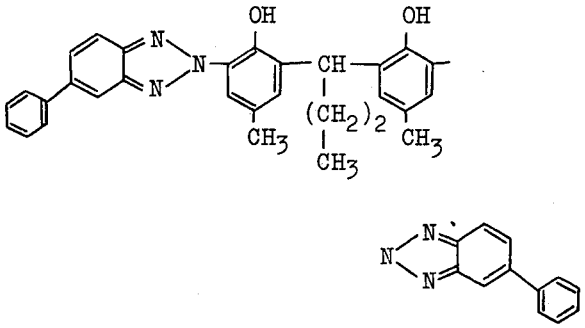
Compound No. 10
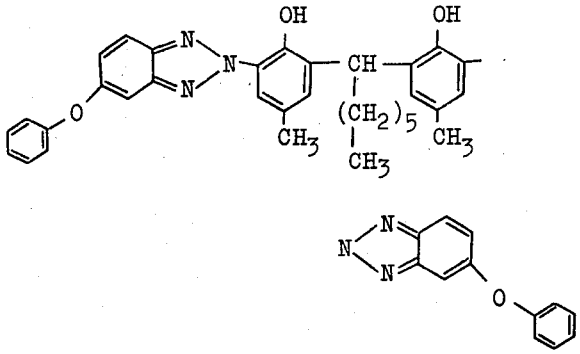
Compound No. 11
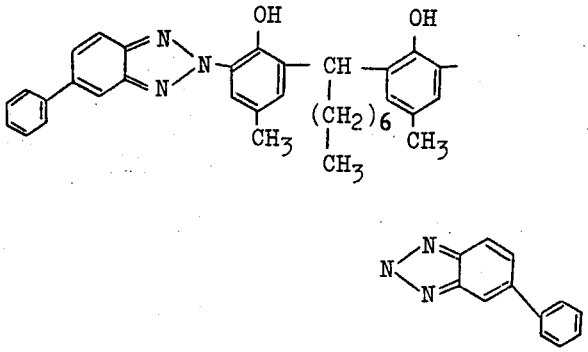

Among the compounds of the present invention, those having the general formula [I] where $R_1$ is an alkyl group of 5 – 13 carbon atoms are especially excellent as compare with those where $R_1$ is an alkyl group of 1 – 4 carbon atoms in solubility in solvent and the former compounds contained in a gelatin layer or an emulsion layer have no adverse effects such as separation of crystals and furthermore can be contained in a larger amount.

The novel compounds of the present invention may be synthesized by the following method.

Synthesis of compound No. 1 (2,2′-octylidene bis[4-methyl-6-(5″-methylbenzotriazolyl)-phenol])

Dried hydrogen chloride is introduced into a benzene solution containing 129.6 g of p-cresol, 64.1 g of n-caprylaldehyde and 2 ml of n-dodecylmercaptan at room temperature for 4 hours. This is left to stand overnight at room temperature. Thereafter, the reaction liquid is washed with water, washed with 1N aqueous solution of sodium bicarbonate until the wash liquid shows weak acidicity and then again washed with water. After the benzene layer is dried, the solvent is distilled out and the residue is distilled under reduced pressure to obtain a fraction of 165° – 175°C/1 Torr. The fraction is recrystallized from n-hexane to obtain white crystal of 2,2′-octylidene bis(4-methylphenol) having a melting point of 107.8° – 108.8°C.

Separately, 120 ml of concentrated hydrochloric acid and 40 ml of water are added to 60.8 g of 4-methyl-2-nitroaniline and these are sufficiently stirred. Thereafter, 50 ml of water containing 28.9 g of sodium nitrite is added dropwise thereto at 0°C over a period of 10 minutes. Furthermore, this is stirred for another 100 minutes and a small amount of sulfamic acid is added thereto and undissolved matter is filtered off to obtain a diazonium solution.

32.6 g of 2,2′-octylidene bis(4-methylphenol) obtained hereinabove is dissolved in a mixed solvent of 300 ml of methyl alcohol and 200 ml of acetone in which 50 g of sodium hydroxide is dissolved. To this solution is added dropwise said diazonium solution with stirring at a temperature of 0° – 10°C. After stirring for another 2 hours, glacial acetic acid is added thereto to obtain a pH of 4. Thus obtained oily product is recrystallized from ethanol.

6.5 g of this 2,2′-octylidene bis[4-methyl-6-(4″-methyl-2″-nitrophenylazo)phenol] is suspended in 100 ml of ethanol and heated to reflux temperature. 50 ml of water containing 8.4 g of sodium hydroxide is added to the suspension and furthermore, 6.5 g of zinc powder is added little by little. Refluxing is further carried out for 1 hour. Thereafter, the zinc powder is filtered out with warm and pH of the filtrate is made 4 – 5 with 1N hydrochloric acid to separate crystal, which is filtered off. The crystal is recrystallized from ethanol to obtain compound No. 1 having a melting point of 144.2° – 145.5°C.

Elementary Analysis: Found: C: 73.63, H: 6.80, N: 14.36.
Calcd.: C: 73.44, H: 6.85, N: 14.27. Mass analytical value: 588. (calcd: 588.75).

Other compounds of the present invention may be synthesized in the similar manner.

For example, compound No. 4 is synthesized in the same manner as mentioned above except that n-dodecyl aldehyde is substituted for n-caprylaldehyde and 2-nitroaniline is substituted for 4-methyl-2-nitroaniline. The compound No. 4 has a melting point of 100.5° – 102.0°C.

The compound according to the present invention may be incorporated into color photographic elements in a wide range of concentration. Usually, the compound is contained in an amount of 50 – 4000 mg per 1 $m^2$ of the color photographic photosensitive material and preferably in an amount of 200 – 2000 $mg/m^2$. Optimum concentration of the compound should be determined depending upon color photographic photosensitive material to be protected.

The compound according to the present invention may be added to silver halide emulsion layer containing color former or may be added to photosensitive materials other than the silver halide emulsion layer. The layer containing the compound according to the present invention can be disposed at an optional position in the photosensitive material, but preferably it should be placed above the layer which forms color images.

The compound of the present invention may be used alone or in combination of two or more. Furthermore, the compound may also be used in combination with other ultraviolet ray-absorbing agents.

The compound of the present invention is excellent in compatibility with solvent and is stable for a long period of time in the state of dispersion in hydrophilic protective colloid solution such as gelatin which contains a high boiling point organic solvent, etc. Furthermore, it has an extremely high absorbance per unit weight. Moreover, the layer containing the compound of the present invention is completely transparent and colorless at dry state. The compound is very stable in a photographic treating bath containing color developing solution, etc., causes no coloration of itself, has no adverse effect on other photosensitive materials and shows no yellowing due to exposure for a long period of time.

Therefore, the compound of the present invention is markedly effective as ultraviolet ray-absorbing agent in photographic photosensitive materials.

The following Examples show that the novel compound of the present invention is superior, as ultraviolet ray-absorbing agent for photograph, to the known hydroxybenztriazole ultraviolet ray-absorbing agent. The known hydroxybenztriazole compounds used as comparative compounds are as follows:

Compound No. 12

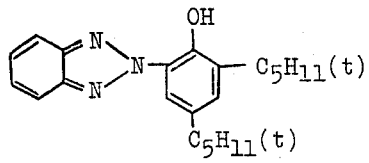

Compound No. 13

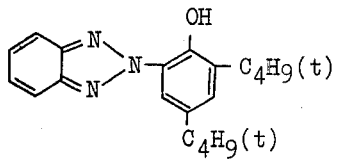

Compound No. 14

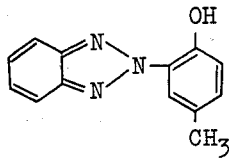

Compound No. 15

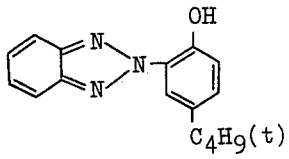

"Parts" used in this specification are given as parts by weight.

EXAMPLE 1

A photosensitive silver halide emulsion containing usual color former, stabilizer, and hardener was coated on an undercoated polyester film. As the color former, 1-(2′,4′,6′-trichlorophenyl)-3-{α-(m-pentadecylphenoxy)butylamide}-5-pyrazolone was used. Then, a dispersion of dibutylphthalate (3 parts) containing the ultraviolet ray-absorbing agent (2 parts) enumerated in Table 1 in aqueous solution of gelatin was coated on said emulsion layer and was dried. The ultraviolet ray-absorbing agent was added so that it was contained in an amount of 400 mg per 1 $m^2$. Thus obtained photosensitive materials were exposed through an optical wedge and then were treated with developer having the following compositions for 6 minutes.

| | |
|---|---|
| Sodium hydroxide | 1.6 g |
| Sodium metaborate | 50 g |
| Anhydrous sodium sulfite | 1.8 g |
| Potassium bromide | 0.5 g |
| 4-Amino-N-ethyl-N-(β-methane sulfonamide ethyl)-m-toluidine sesquisulfate | 4.4 g |
| Sodium hexametaphosphate | 0.5 g |
| Hydroxylamine chlorate | 1.0 g |
| Benzyl alcohol | 24 ml |
| Diethylene glycol | 10 ml |
| Water to make 1.0 l | |

Then, the photosensitive materials were bleached and fixed with EDTA iron salt bleaching and fixing solution having the following compositions for 4 minutes.

| | |
|---|---|
| EDTA-iron salt | 56 g |
| EDTA-2-sodium salt | 2.0 g |
| Ammonium thiosulfate | 60 g |
| Anhydrous sodium sulfite | 20 g |
| Acid sodium sulfite | 5.0 g |
| Phosphoric acid-2-sodium salt | 12 g |
| Water to make 1.0 l | |

Then, the fixed photosensitive materials were washed with water for 8 minutes and thereafter dipped for 3 minutes in a stabilizing bath which was usually employed and dried to obtain samples having magenta dye images. Thus obtained samples were exposed to light from luminescent lamp (5,000 lux) for 4 weeks and to sun light for 2 weeks, respectively. Using Macbeth color densitometer TD404, relative fading degree of these samples at an initial density of 1.0 with transmitting light through Wratten filter No. 93 and relative yellowing degree thereof at minimum initial density with transmitting light through Wratten filter No. 92 were measured to obtain the results as shown in Table 1.

Table 1

| Ultraviolet ray-absorbing agent | Relative fading degree of samples after exposed to luminescent lamp for 4 weeks | Relative yellowing degree of samples after exposed to sun light for 2 weeks |
|---|---|---|
| None | 100 | 100 |
| Compound No. 12 (not the present invention) | 58 | 48 |
| Compound No. 3 | 24 | 48 |
| Compound No. 4 | 43 | 50 |

As is clear from the above results, the ultraviolet ray-absorbing agents of the present invention had ultraviolet ray-absorbing effect which is not less than that of the known hydroxybenzotriazole.

EXAMPLE 2

One part of dibutyl phthalate and one part of ultraviolet ray-absorbing agent were heated and melted at 60° and then left to stand at room temperature to measure time required for separation of crystal of the ultraviolet ray-absorbing agent. The results are shown in Table 2.

Table 2

| Ultraviolet ray-absorbing agent | Time required for beginning of separation of crystal | Time required for complete crystallization |
|---|---|---|
| Compound No. 12 (not the present invention) | 7 minutes | 20 minutes |
| Compound No. 13 (not the present invention) | not dissolved | — |
| Compound No. 14 (not the present invention) | 4 minutes | 7 minutes |
| Compound No. 15 (not the present invention) | not dissolved | — |
| Compound No. 3 | 110 minutes | more than 24 hours |
| Compound No. 4 | 95 minutes | more than 24 hours |

As is clear from the above results, the ultraviolet ray-absorbing agents of the present invention are markedly superior to the known hydroxybenzotriazole ultraviolet ray-absorbing agents in solubility in organic solvent.

EXAMPLE 3

A dispersion comprising 0.4 g of ultraviolet ray-absorbing agent, 0.8 ml of cyclohexane, 0.6 ml of dibutyl phthalate and 0.9 g of gelatin and 6 ml of water was added to 100 ml of aqueous solution containing 6 g of gelatin. These samples were kept at 40°C. Separation of crystal of the ultraviolet ray-absorbing agents in these samples was observed. The results are shown in Table 3.

Table 3

| Ultraviolet ray-absorbing agent | State of the dispersion |
|---|---|
| Compound No. 13 (not the present invention | After lapse of 1 hour, crystal began to be separated. |
| Compound No. 3 | No crystal was separated even after lapse of more than 23 days. |
| Compound No. 4 | " |
| Compound No. 2 | Crystal was not separated for 10 days. |

As is clear from the above results, the ultraviolet ray-absorbing agents of the present invention maintain extremely stable state in the dispersion. These results show that the ultraviolet ray-absorbing agents of the present invention are very useful in color photographic photosensitive materials.

As shown in the above Examples, the ultraviolet ray-absorbing agents of the present invention have excellent compatibility with solvents and maintain stable dispersion state for a long time when dispersed in hydrophilic protective colloid solution such as gelatin together with a high boiling point organic solvent. Therefore, the ultraviolet ray-absorbing agents of the present invention can be used in color photosensitive materials together with a small amount of organic solvent. Furthermore, amount of the ultraviolet ray-absorbing agents added may be increased without giving adverse effect on photographic characteristics. In addition, the ultraviolet ray-absorbing agents of the present invention show no coloration, change in color due to exposure to light, are inert and extremely stable in photographic treating bath containing color development treating solution, show a great light absorbancy per unit weight and do not damage photographic characteristics.

What is claimed is:

1. A color photographic photosensitive material which comprises a support and photographic layers coated thereon, said photographic layers having incorporated therein an ultraviolet ray-absorbing compound represented by the formula:

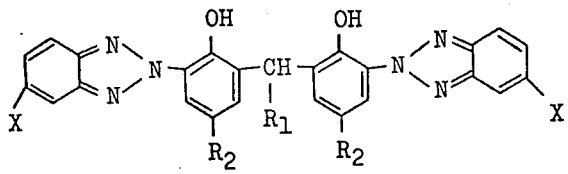

wherein $R_1$ is an alkyl group having 1 to 13 carbon atoms, $R_2$ is an alkyl group having 1 to 18 carbon atoms and X is a member selected from the group consisting of hydrogen, halogens, alkyl, alkoxy, aryloxy, aralkyloxy and aryl groups.

2. A color photographic sensitive material according to claim 1, wherein $R_1$ is an alkyl group of 5 to 13 carbon atoms.

3. A color photographic sensitive material according to claim 1 wherein the ultraviolet ray-absorbing compound is:

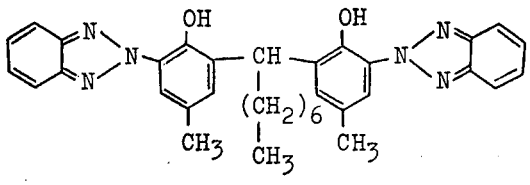

4. A color photographic sensitive material according to claim 1 wherein the ultraviolet ray-absorbing compound is:

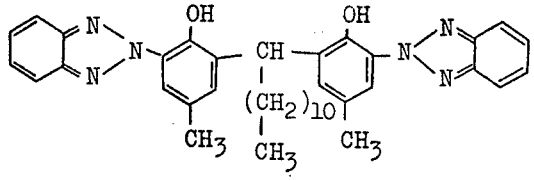

5. A color photographic photosensitive material according to claim 4, wherein the amount of the ultraviolet ray-absorbing compound incorporated is 50 – 4,000 mg/m².

6. A color photographic sensitive material according to claim 1 wherein the ultraviolet ray-absorbing compound is:

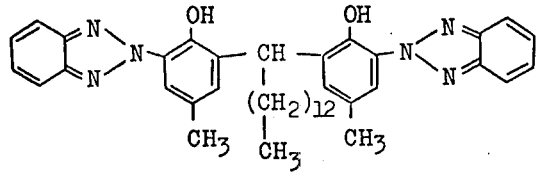

7. A color photographic photosensitive material according to claim 6, wherein the amount of the ultraviolet ray-absorbing compound incorporated is 50 – 4,000 mg/m².

8. A color photographic sensitive material according to claim 1 wherein the ultraviolet ray-absorbing compound is:

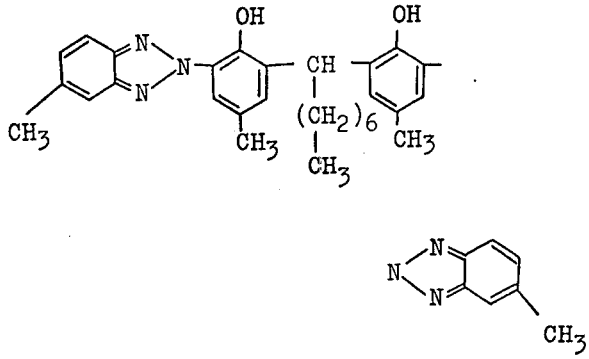

9. A color photographic sensitive material according to claim 1 wherein the ultraviolet ray-absorbing compound is:

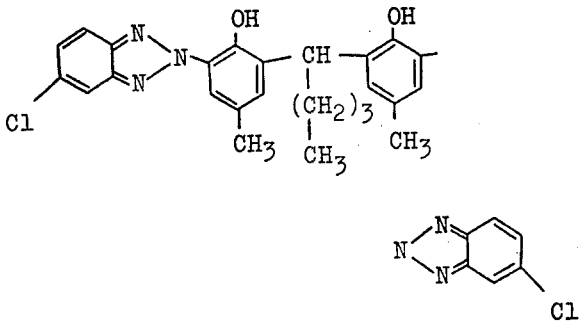

10. A color photographic sensitive material according to claim 1 wherein the ultraviolet ray-absorbing compound is:
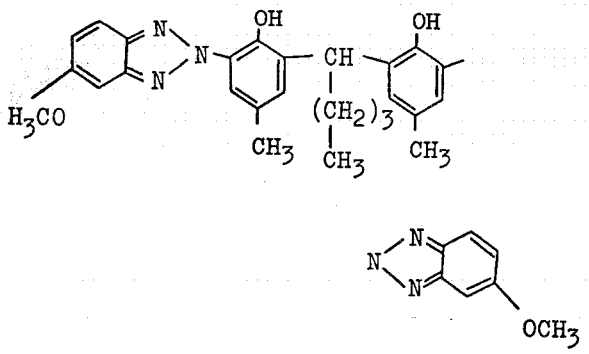
11. A color photographic sensitive material according to claim 1 wherein the ultraviolet ray-absorbing compound is:
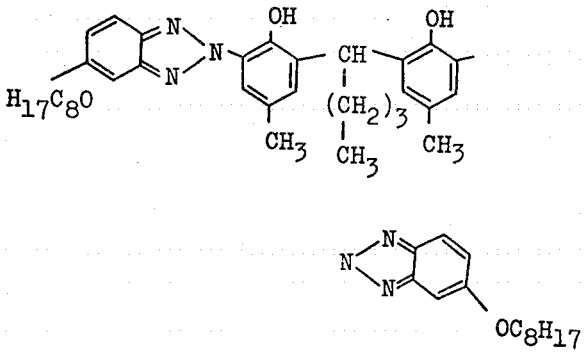
12. A color photographic sensitive material according to claim 1 wherein the ultraviolet ray-absorbing compound is:
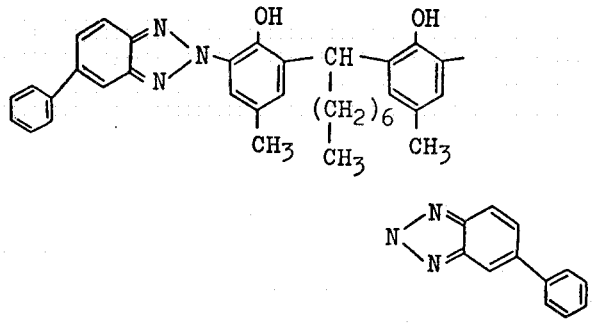
13. A color photographic sensitive material according to claim 1 wherein the ultraviolet ray-absorbing compound is:
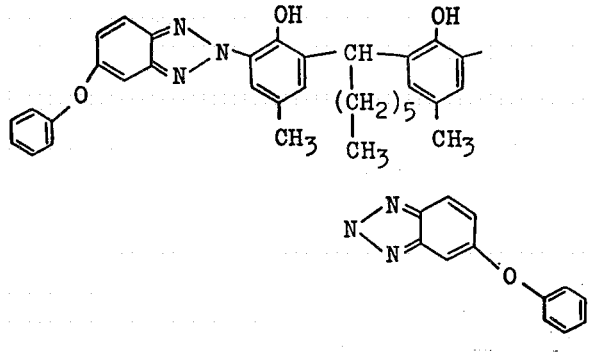
* * * * *